US006324791B1

(12) United States Patent
Azpiroz Villar

(10) Patent No.: US 6,324,791 B1
(45) Date of Patent: Dec. 4, 2001

(54) PREFABRICATED HUTS IN MODULES

(76) Inventor: Francisco Javier Azpiroz Villar, Plaza Eibar, 2-2º C 20011, San Sebastian, Guipuzcoa (ES)

( * ) Notice: Subject to any disclaimer, the term of this patent is extended or adjusted under 35 U.S.C. 154(b) by 0 days.

(21) Appl. No.: 09/551,451

(22) Filed: Apr. 18, 2000

(30) Foreign Application Priority Data

Mar. 29, 2000 (ES) ..... P-200000773

(51) Int. Cl.[7] ..... E04B 1/32
(52) U.S. Cl. ..... 52/80.1; 52/82; D25/19
(58) Field of Search ..... 52/82, 80.1, 81.1

(56) References Cited

U.S. PATENT DOCUMENTS

D. 363,993 * 11/1995 Johnson et al. ..... D25/19
D. 396,115 * 7/1998 Zobel, Jr. ..... D25/19
3,513,608 * 5/1970 Nagrod ..... 52/82
5,341,610 * 8/1994 Moss ..... 52/82

* cited by examiner

*Primary Examiner*—Carl D. Friedman
*Assistant Examiner*—Steve M. Varner
(74) *Attorney, Agent, or Firm*—Bierman, Muserlian and Lucas

(57) ABSTRACT

Prefabricated hut in modules, of the kind that has four sides, two similar sides, a lower one and an upper one, where the cross sections of the module, viewed from the inside, are concave in the areas close to the lower side and convex in the areas close to the upper side, with an intermediate area where there is a progressive change in curvature, which is situated closer to the lower side than to the upper side.

5 Claims, 3 Drawing Sheets

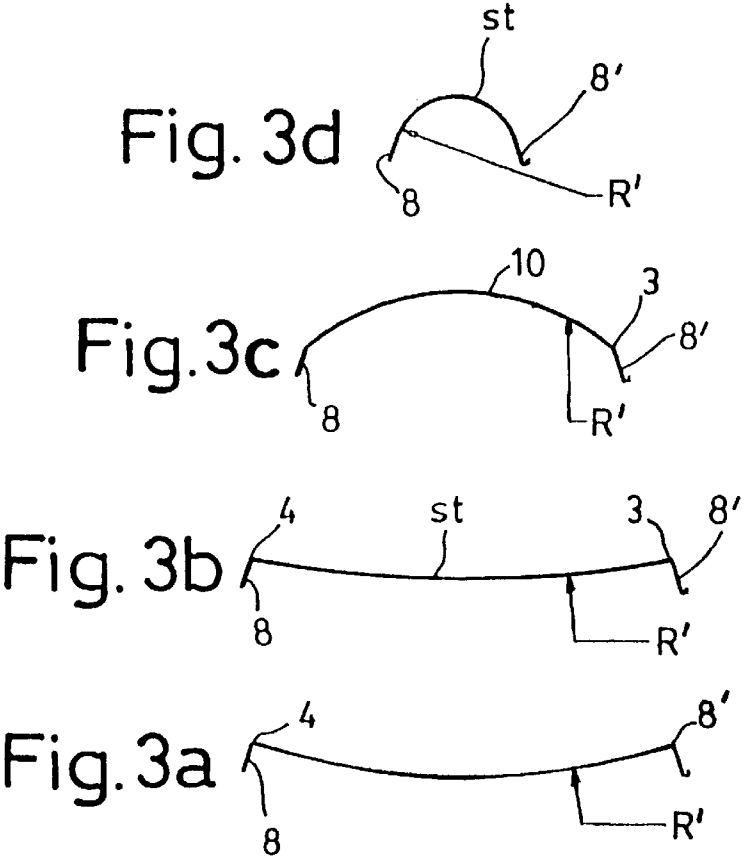
Fig. 3d
Fig. 3c
Fig. 3b
Fig. 3a
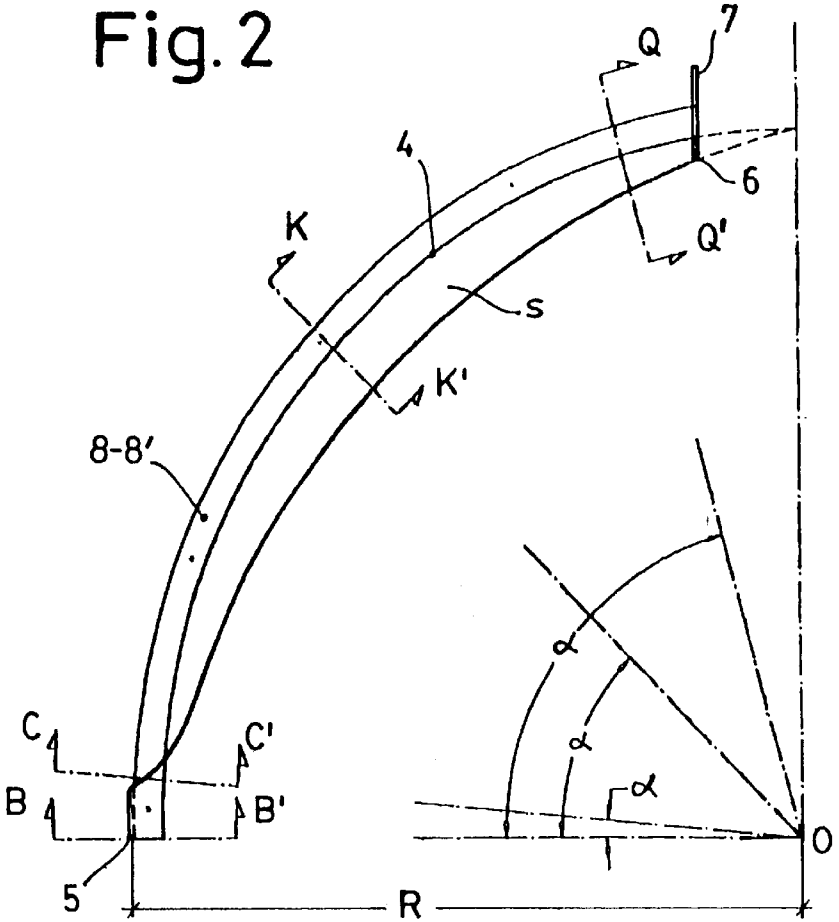
Fig. 2

PREFABRICATED HUTS IN MODULES fabricated huts made from modules that are transported and assembled "in situ" are already known.

More specifically, huts that are shaped approximately like a semi-sphere based on semi-spherical lune modules are well-known, for example Utility Models 164.457, 292.023, Pat. No. 2,134,683 of Spain or U.S. Pat. No. 2,176,712.

These huts are normally used for outdoor shelter.

All of the known huts suffer from the essential defect that in order to be resistant to the forces of nature, such as snow and wind, the material used to make each of the modules is too thick. This means that they are expensive to manufacture and hard to transport, handle and assemble.

This defect has been overcome by the hut of the invention, due to the geometry of each module, which progressively changes from a concave to convex shape.

A vertical section taken through the center of a module of the invention, has a geometry, which, when viewed from the outside, is concave in the upper part and convex in the lower part. This S-shaped geometry represents a considerable increase in the moment of inertia with respect to the axis of the element.

A horizontal section, for example, at the center point of the assembled hut, has a geometry that is a repetition of concave shapes forming a convex shape at the point where the elements are join together. This also represents a much greater moment of inertia with respect to the axis, than any other geometry of the prior art huts made from modules.

The geometry of the invention improves the static performance(snow loads) as well as repetitive variable intensity loads (action of the wind) of each module and of the hut as a whole, thus permitting the use of less thick modules with the relative saving of material.

The whole hut is lighter in weight, meaning that it can be assembled on soft ground and levelled areas because it is not necessary for the land to be prepared to support pillars or supports as often occurs with known prefabricated huts.

Features of the invention include:

- The design of the geometry of each module is such that they are manufactured as elementary single-pieces, that is, they are not comprised of other parts, pieces or reinforcements, so there are no joints.
- The modules are stacked together guaranteeing the safety of the pack as one part fits into another, preventing the module from slipping, thereby taking up minimal space, and thus optimizing both transport and storage, due to their formal and structural design.
- Each individual module is improved as, dimensionally, its shape is maintained, therefore improving its breaking behaviour, each element being able to be handled individually, thus facilitating the assembly.

This invention advocates a hut with outside modular walls, of the kind with four sides, two sides which are similar to each other, a lower one and an upper one, which is characterized because when the cross sections of the modules are viewed from the inside, they are concave in the areas close to the lower side and convex in the areas close to the upper side, with an intermediate area where the curvature progressively changes.

The invention is also characterized because the module is shaped approximately like a semi-spherical lune, where its cross sections (st) are carried out from the center of the sphere at different tilt angles ($\alpha$) where (R) is the radius of the sphere and (R') is the radius of curvature of each cross section (st), such that:

| | | |
|---|---|---|
| if $\alpha = 0$ | $R' = R$ | st = concave |
| if $4° \leqq \alpha \leqq 10°$ | $1.5\ R \leqq R' \leqq 2\ R$ | st = concave |
| if $\alpha = 45°$ | $R' = R/2$ | st = convex |
| if $70° \leqq \alpha \leqq 80°$ | $R/10 \leqq R' \leqq R/12$ | st = convex |

For a better understanding of this invention, a preferred form of the invention is shown in the drawings, which are susceptible to accessory changes that take nothing away from its basics.

FIG. 2 is a sectional view taken along line DD' of the module (1) of FIG. 1;

Figure 1:
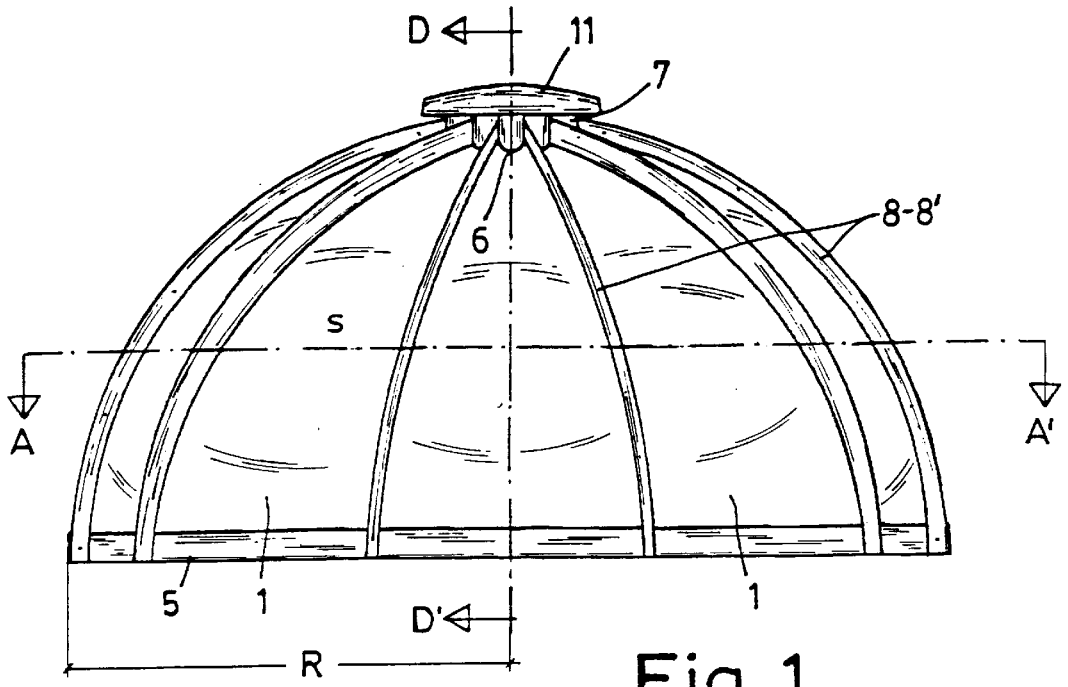
FIG. 1 is an elevation view of the invention where the hut is approximately semi-spherically-shaped.
Figure 4:
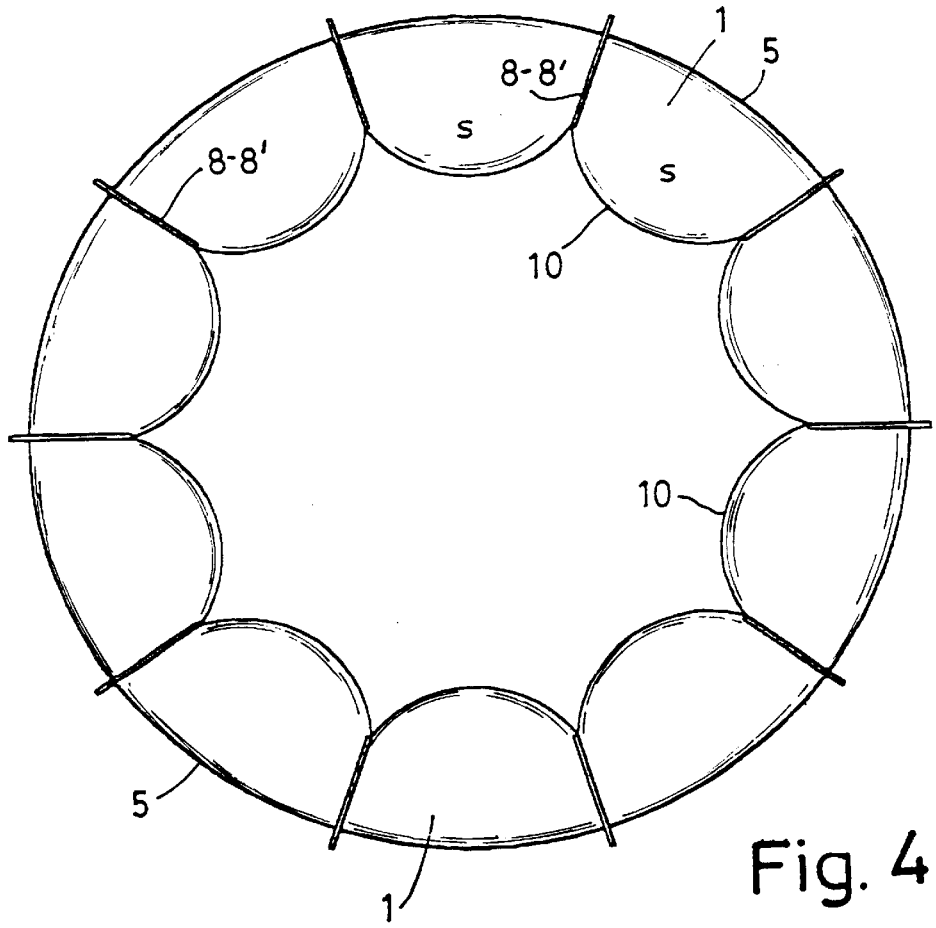
Figure 5:
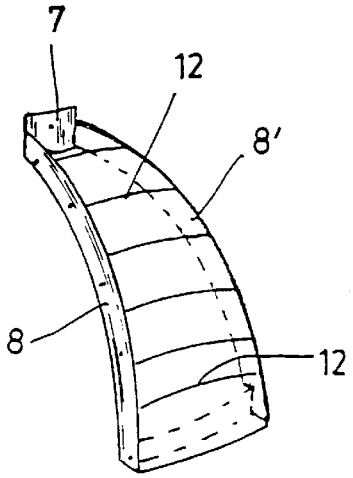
Figure 6:
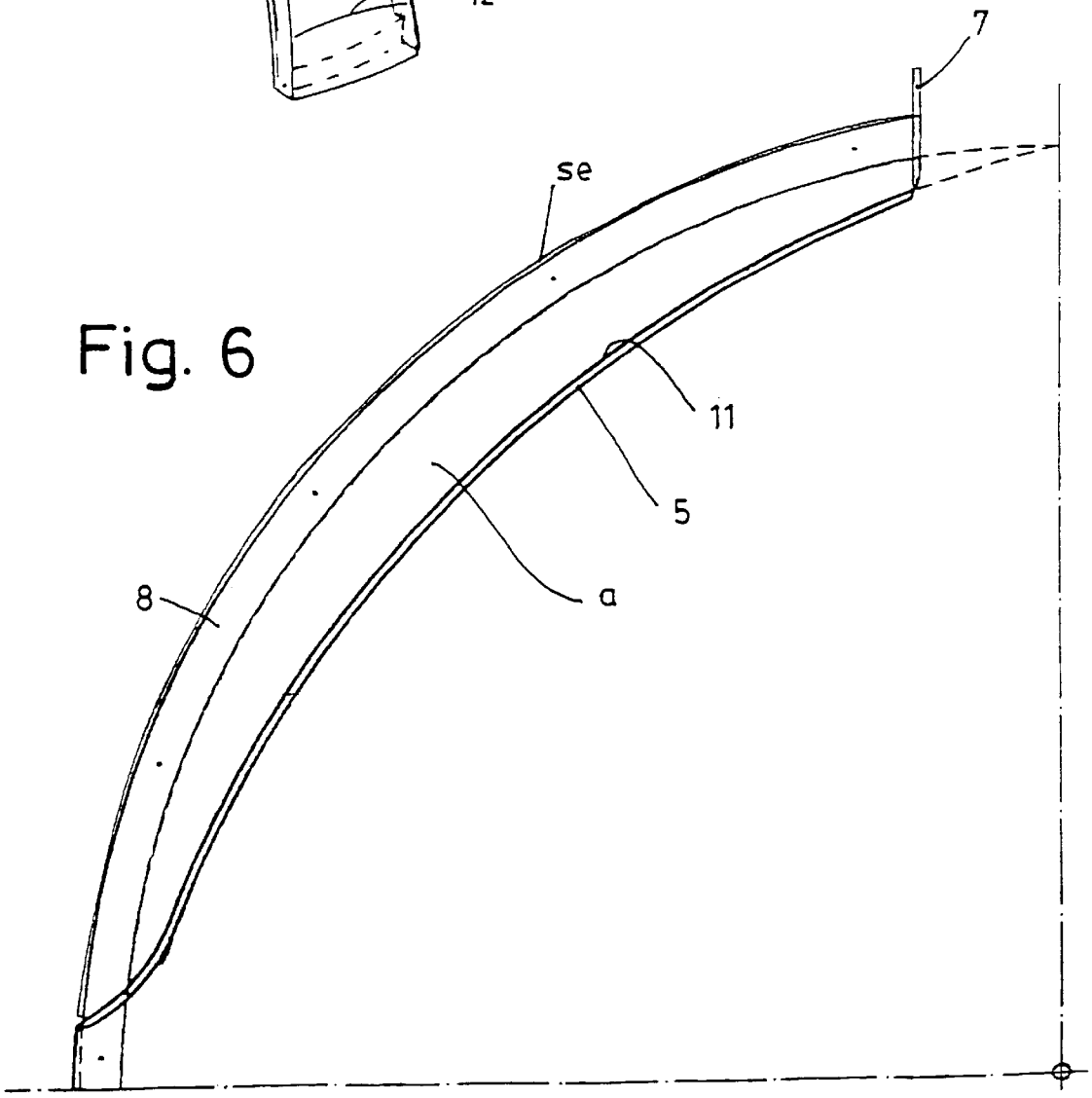

FIGS. 3*a*, 3*b*, 3*c*, 3*d* are sectional views taken along lines CC', KK', QQ' respectively of FIG. 2, but in a head-on manner of the module;

FIG. 4 is a sectional view taken along line AA' of FIG. 1;

FIG. 5 is a perspective view of module (1) with sandwich structures; and FIG. 6 is a sectional view taken along line DD' of the module of FIG. 1 with the sandwich structure of FIG. 5.

Below is an example of a practical, non-limitative, execution of this invention.

The huts of the invention can have any ground plan shape, for example like a circus marquee, ovoid, etc. although they will preferably be semi-spherical as shown in FIG. 1.

Module (1) has four sides: two sides (3), (4) similar to each other, lower side (5) and upper side (6).

If upper side (6) is, in projection, dimensionally similar to lower side (5), module (1) will be rectangular in shape, if it is different it will be trapezium-isosceles-shaped as in FIG. 1 and if the dimension of the upper side should be null, it would be an isosceles triangle.

Sides (3), (4) have traditional anchoring means (8), (8') to fasten them together, for example, screwed, riveted, glued, braced, press-fitted, etc.

Upper side (6) can have arched finish (7), with or without metal hoop, with or without larmier or light well (11), all of which is conventional.

Lower side (5) can have reinforcement, union or sealing elements.

The material used to make module (1) can be metal, plastic, or composites, etc.

FIG. 1 shows that surface (5) of each module (1) is approximately semi-spherical lune in shape and the hut has generatrix radius (R). The surface of this semi-lune of module (1) does not have, at least in its cross-radial sections (known as parallels) an even radius and it does not maintain its concavity, this is the essence of the invention.

FIG. 4 shows that in section AA taken approximately half way up the hut, section (10) of each module (1) is convex viewed from the inside, whilst the outside edge, that is, lower side (5) is concave.

It can be seen in FIGS. 2 and 3 that as tilt angle ($\alpha$) increases, with which the radial sections are made from center (0) of the theoretic sphere, the curvature of the cross sections in the semi-lune of module (1), gradually changes from concave to convex. Thus, the statics and dynamics of the module are improved, a great increase in the moment of inertia is achieved with smaller thicknesses.

Preferably the area of progressive change in curvature is closer to lower side (5) than upper side (6).

As an example, good results are obtained, with respect to an increase in habitability and mechanical resistance, under the conditions indicated below, where (R') is the radius of curvature of each cross section (st) see FIG. 3.

| SECTION | R' | α | CURVATURE st |
|---|---|---|---|
| BB' | R' = R | α = 0° | CONCAVE |
| CC' | R' = 1.75 R | α = 5° | CONCAVE |
| KK' | R' = R/2 | α = 45° | CONVEX |
| QQ' | R' = R/11 | α = 75° | CONVEX |

The structure of each module (1)can be sandwich type or multi-layer.

The sandwich type structure can form from one inner wall and another outer wall with similar curvatures, the inner wall having sphere curvature or any other type, the intermediate product between both surfaces being air or another insulating material.

Part of the object of the invention is to make the hut with an outside module structure and an inside modular structure.

FIGS. 5 and 6 show a module with sandwich structure where the inner wall is the one that has been identified as surface (S) of the module in FIGS. 1 to 4, which is made of thermoplastic, polyester, composite, metal, etc. Outer wall (Se), which in this case is sphere-shaped, can be of a similar material to that used for inner wall (S) or it can be made of fabric, for example canvas. Insulating layer (11) is presented with inner wall (S), which can, for example, be of polyurethane, glass canvas, etc., with air (a) filling the unit. Preferably these elements (S), (Se), (11) are assembled "in situ", but they can come in a block.

For greater rigidity of the outer wall (Se) it can be supplied with transversal ribs (12).

What is claimed is:

1. Prefabricated hut in modules, of the kind that has four sides, two that are similar to each other, one lower one and one upper one, characterised because viewed from the inside the cross sections of the module are concave in the areas close to the lower side and convex in the areas close to the upper side, with an intermediate area where there is a progressive change in curvature.

2. Prefabricated hut in modules, according to claim 1, the area of progressive change in curvature is closer to the lower side than to the upper side.

3. Prefabricated hut in modules, according to claim 1, the module is approximately spherical semi-lune in shape and where cross sections (st) are carried out from the center of this sphere at different tilt angles (α), where (R) is the radius of the sphere and (R') the radius of curvature of each cross section (st), it is true, approximately, that:

| | | |
|---|---|---|
| if α = 0 | R' = R | st = concave |
| if 4° ≦ α ≦ 10° | 1'5 R ≦ R' ≦ 2 R | st = concave |
| if α = 45° | R' = R/2 | st = convex |
| if 70° ≦ α ≦ 80° | R/10 ≦ R' ≦ R/12 | st = convex. |

4. Prefabricated hut in modules, according to claim 1, the structure of each module is sandwich type or multi-layer.

5. Prefabricated hut in modules, according to claim 4, caracterised ecause the sandwich structure is comprised of an inside wall, an outside wall and at least one insulating element between them.

* * * * *